US006052934A

United States Patent [19]

Carpenter

[11] Patent Number: 6,052,934

[45] Date of Patent: Apr. 25, 2000

[54] LOCKABLE SAFETY DEVICE FOR AN AUTO-LOADING FIREARM

[76] Inventor: Barry O. Carpenter, 722 N. 4th Ave., Paden City, W. Va. 26159

[21] Appl. No.: 09/177,887

[22] Filed: Oct. 23, 1998

Related U.S. Application Data

[60] Provisional application No. 60/088,600, Jun. 9, 1998.

[51] Int. Cl.[7] ..... F41A 17/36

[52] U.S. Cl. ..... 42/70.11

[58] Field of Search ..... 42/70.11; 47/70.01

[56] References Cited

U.S. PATENT DOCUMENTS

| | | | |
|---|---|---|---|
| 4,528,765 | 7/1985 | Johnson | 42/70.11 |
| 4,532,729 | 8/1985 | Von Muller | 42/70.11 |
| 4,619,062 | 10/1986 | Johnson | 42/1 |
| 4,835,894 | 6/1989 | Libassi | 42/70.11 |
| 4,965,952 | 10/1990 | Miller et al. | 42/70.01 |
| 5,042,185 | 8/1991 | Justice, Sr. | 42/70.11 |
| 5,097,613 | 3/1992 | Miller et al. | 42/70.01 |
| 5,331,759 | 7/1994 | Marceau et al. | 42/70.11 |
| 5,361,526 | 11/1994 | Campbell | 42/70.11 |
| 5,410,832 | 5/1995 | Barnhart | 42/70.11 |
| 5,419,069 | 5/1995 | Mumbleau | 42/70.11 |

FOREIGN PATENT DOCUMENTS

| | | | |
|---|---|---|---|
| 2561369 | 9/1985 | France | F41C 27/08 |
| 004009372 | 10/1990 | Germany | 42/70.11 |

*Primary Examiner*—Charles T. Jordan
*Assistant Examiner*—Denise J Buckley
*Attorney, Agent, or Firm*—Richard C. Litman

[57] ABSTRACT

A lockable safety device that may be installed on handguns, rifles or other firearms having a clip or magazine and an exposed breech area. The safety device comprises an elongated body with a transverse member at one end, and a series of spaced openings along the length of the body, ending before the second end. The openings receive the shank of a padlock. With the slide of the gun retracted to open the ejection port, the safety device is installed by inserting the second end of the body into the ejection port and continually advancing the body through the magazine well until the transverse member engages the upper surface of the slide.

8 Claims, 2 Drawing Sheets

LOCKABLE SAFETY DEVICE FOR AN AUTO-LOADING FIREARM

CROSS-REFERENCE TO RELATED APPLICATION

This application claims the benefit of U.S. Provisional Patent Application Ser. No. 60/088,600, filed Jun. 9, 1998.

BACKGROUND OF THE INVENTION

1. Field of the Invention

The present invention relates generally to devices for preventing the accidental or unintentional discharge of a firearm. More specifically, it relates to a lockable device that may be installed on handguns, rifles or other firearms having a clip or magazine and an exposed breech area.

2. Description of Related Art

The number of accidental shootings caused by careless handling of firearms that are thought to be unloaded or that were in the hands of inexperienced operators is well known and publicized. In fact, it has been stated that firearms are the leading cause of accidental deaths in children ages 14 and under. Nearly 90% of accidental shootings occur in the home of the victim or that of a close friend or relative. Although many firearm owners attempt to hide a firearm kept in the home, children often know where it is hidden or later discover its location. Public safety messages are broadcast through various media sources, but accidental shootings still occur at an alarming rate. Accordingly, many firearm owners employ aftermarket safety devices to reduce the risk of accidental misuse.

Various types of aftermarket firearm safety mechanisms are known. These mechanisms include: (1) bore locks which require the insertion of a plug or lockable bar through the bore or barrel of the forearm, (2) trigger guard locks that enclose the trigger guard area to prevent insertion of a finger or block rearward movement of the trigger itself, and (3) frame-mounted locks which integrate a blocking device or active locking mechanism into one or more operations of the firearm, such as the manual safety, hammer drawback or drop, or magazine insertion.

The art related to bore locks includes various breech locks, breech stops and chamber plugs designed for insertion into the breech of a firearm usually with a retractable pin or plug projecting into the breech end of the barrel and sometimes rearwardly to engage the breech block, bolt, frame, or slide. Representative examples of various bore and breech blocking mechanisms are shown in U.S. Pat. No. 4,835,894, issued to Libassi on Jun. 6, 1989; U.S. Pat. No. 4,965,952, issued to Miller et al., on Oct. 30, 1990; U.S. Pat. No. 5,097,613, issued to Miller et al., on Mar. 24, 1992, U.S. Pat. No. 5,331,759, issued to Marceau et al., on Jul. 26, 1994; and U.S. Pat. No. 5,410,832 issued to Barnhart on May 2, 1995.

Of the bore lock mechanisms listed above, those including a key-operated securing means are relatively complicated and expensive to manufacture. The remainder of the bore lock mechanisms, while simple to use and produce, do not have the additional safety feature of a key-operated means for permanently securing the mechanism to the firearm.

The field of frame-mounted locks include various locking mechanisms that interact with both the frame and a dummy magazine to hold the dummy magazine in place while the lock is engaged and to prevent loading or discharging the firearm. These locking mechanisms may also include a magazine block or plug that obstructs the loading or passage of ammunition through or from a tubular, stacked or drum magazine. Representative examples of various magazine locking mechanisms are shown in U.S. Pat. No. 4,528,765 issued to Johnson on Jul. 6, 1985; U.S. Pat. No. 4,532,729 issued to Von Muller on Aug. 6, 1985; and U.S. Pat. No. 4,619,062 issued to Johnson on Oct. 28, 1986.

The magazine locks of Johnson ('765 patent) and Von Muller are complicated to employ and construct. On the other hand, the Johnson magazine block ('762 patent), while cheaper to produce and simple to use, does not offer the additional safety feature of a key-operated means for permanently securing the mechanism to the firearm.

U.S. Pat. No. 5,361,526, issued to Campbell on Nov. 8, 1994, describes a securing device which is used by inserting it through the loading port of a shotgun having a tubular magazine. The securing device blocks the operation of the cartridge elevator and bolt slide. This securing device has the disadvantage of not providing any lock for preventing removal of the device from the secured shotgun.

French Pat. App. No. 2,561,369, published on Sep. 20, 1985, appears to describe a securing means for a weapon.

Summarizing the prior art, it can be seen that most inexpensive and easy to manufacture firearm safety devices lack the additional feature of a lockable means for permanently securing the device to a firearm to resist or prevent unauthorized removal. Those devices employing a lockable means are overly complicated in their design and are, therefore, expensive and more difficult to operate. The present invention, however, provides a straight forward means for rendering a firearm safe by utilizing an uncomplicated design that is inexpensive to manufacture. In addition, it provides a visually verifiable means for easily determining whether a firearm is in a safe condition.

None of the above inventions and patents, taken either singly or in combination, describe the instant invention as claimed.

SUMMARY OF THE INVENTION

The present invention, generally stated, provides a new safety device for use with a firearm having a detachable clip or magazine and an ejection port, such that it prevents ammunition from being introduced into the chamber and, when in place, presents an easily visible indication that the firearm is not loaded.

Briefly described, the preferred embodiment of this invention comprises an elongated body with a transverse member at one end and, ending just before the second end, a series of spaced circular openings centered along the length of the body. With the firearm's bolt or slide retracted so that the breach is exposed and the ejection port is open, and the magazine removed, the second end of the body is inserted into the ejection port and through the magazine well. Insertion of the body continues until the transverse member at the first end engages the upper portion of the ejection port. In a fully inserted position, one or more of the circular openings are exposed outside the firearm. Thus, a lock, such as the shank of a padlock, can be inserted into the exposed circular opening closest to the firearm and locked, to prevent the device from being removed from the firearm by pulling the body back through the magazine well and exposed breech.

It is therefore one object of this invention to provide a lockable device for firearms such as auto-loading pistols or rifles which may be incorporated into existing firearm designs without modification of the frames, receivers, slide assemblies, or other functional elements of the firearm associated with the chambering mechanisms, firing mechanisms, or ejector mechanisms.

It is another important object of this invention to design the above lockable device to make it possible to visually verify that the firearm is in a safe condition for handling.

It is a related object of this invention to design the above lockable device such that it is inexpensive to manufacture, simple to install, and adaptable to a wide variety of firearms.

It is a further object of this invention to design the above lockable device to provide increased security against accidental or unintentional discharge of a firearm.

It is a distinct object of this invention to design the above lockable device such that it may be used to store an auto-loading pistol or rifle and yet permits the safe and rapid removal of the lockable device in the event the firearm is needed for self-defense or a similar emergency.

It is yet another object of this invention to design the above lockable device such that it resists or prevents tampering or circumvention.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
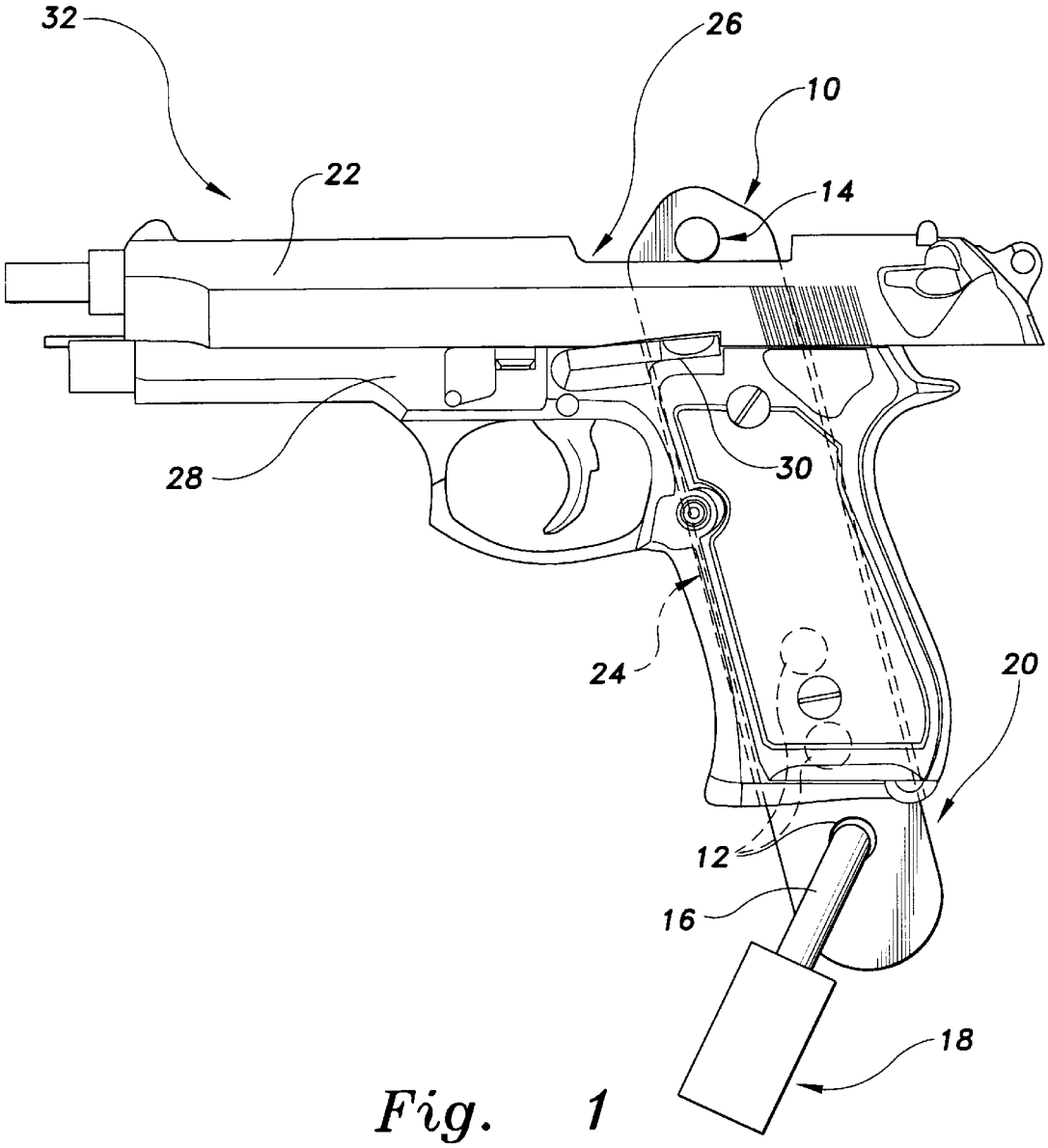
FIG. 1 is a side elevational view of a lockable safety device for an auto-loading firearm according to the present invention installed on a semi-automatic pistol.

With reference first to FIG. 1, the safety device of the subject invention is shown generally at 10 and is shown for reference and descriptive purposes installed on a semi-automatic pistol 32. Although many types of firearms, including pistols and rifles, are suitable for use with the safety device, a generic 9 mm caliber semi-automatic pistol 32 is shown as a representative example of the manner and best mode for utilizing the safety device 10 as described herein.

Figure 2:
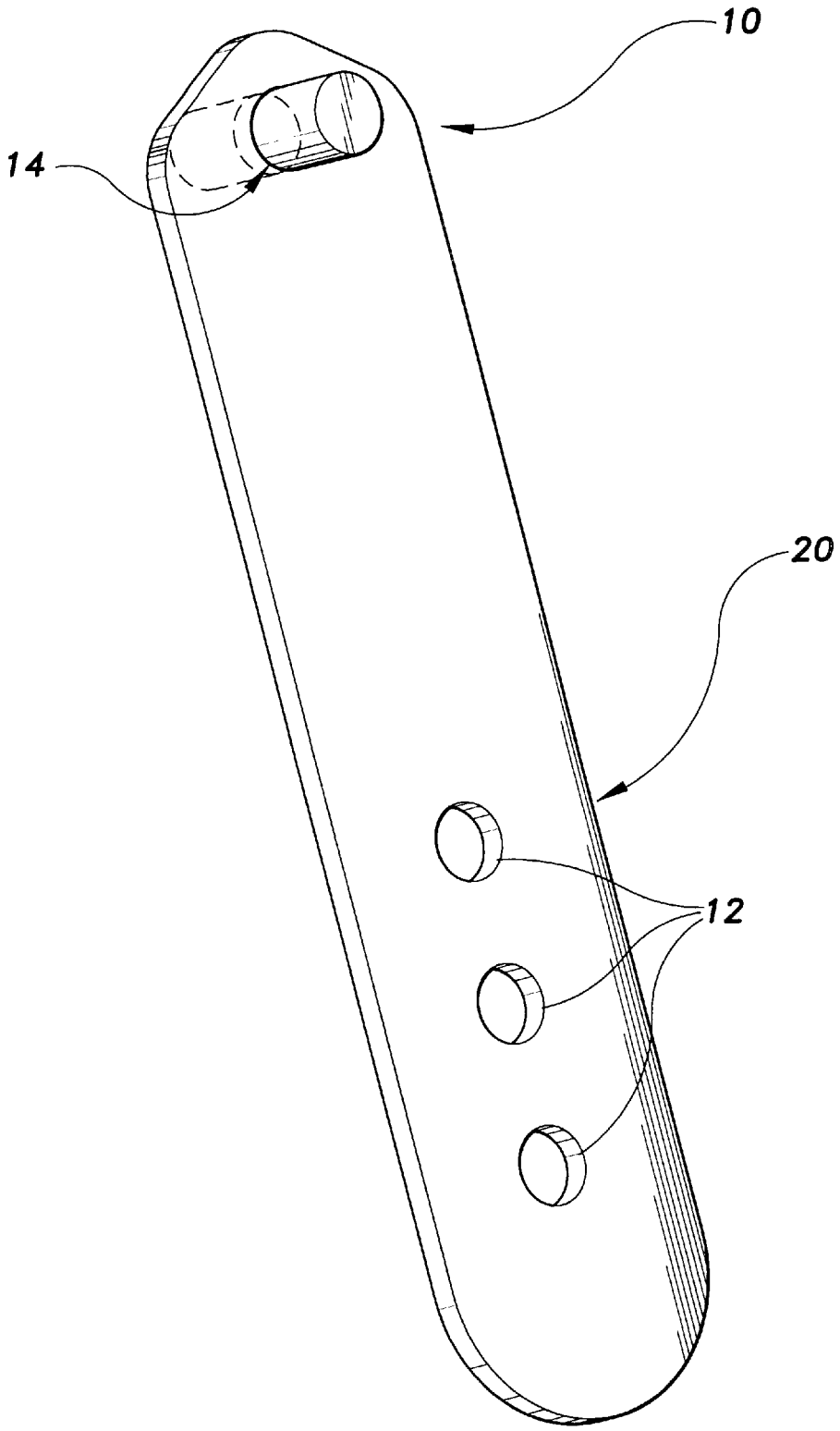
FIG. 2 is a perspective view of a lockable safety device for an auto-loading firearm according to the present invention.

With reference now to both FIGS. 1 and 2, the individual items will be described in greater detail. The safety device 10 comprises an elongated body 20 (hereinafter referred to as the "body"), preferably rectangular in shape, having a first and second end, thereby defining a length therebetween, and a transverse member 14 attached to the first end, preferably at the transverse member's center. The transverse member 14 is preferably an elongated cylinder, substantially perpendicular to the body 20. The body 20 further defines a series of openings 12 spaced along the length, capable of receiving the shank 16 of a padlock 18. The series of openings 12 terminates near the second end of the body 20.

The semi-automatic pistol 32 generally comprises a frame 28 and a slide assembly 22. Within the rear portion of the frame, a magazine well 24 is provided to accept the detachable magazine (not shown) of the semi-automatic pistol 32. To prepare the semi-automatic pistol 32 to use the safety device 10, the slide assembly 22 is retracted to open the ejection port 26. The slide assembly 22 is held in the retracted position by a slide catch 30 pivotally attached to the frame 28. In firearms other than a semi-automatic pistol 32, a similar exposed breech position may be accomplished by retracting the bolt in a bolt-action rifle, for example, or other similar procedures dependent upon the specific structure and operation of the firearm.

The ejection port 26 has set length, width, and depth dimensions which are defined by the operation, structure and caliber of the semi-automatic pistol. In addition, the magazine well 24 has set length, width, and depth dimensions which are defined by the operation, structure and caliber of the semi-automatic pistol. In relation to these dimensions, the body 20 has a width and depth such that it may be inserted with ease into the ejection port 26 and through the magazine well 24 as shown in FIG. 1. The distance between the transverse member 14 and at least one of the holes 12 must be greater than the sum of the slide assembly's height and the magazine well's length. The transverse member 14 must be longer than the width of the ejection port 26 to ensure that transverse member 14 engages the slide assembly 22, thereby preventing its passage through the ejection port 26.

With the slide assembly 22 retracted and held in place by slide catch 30, thereby opening the ejection port 26, the safety device is installed by inserting the second end of the body 20 into the ejection port 26 and continually advancing the body 20 through the magazine well 24 until the transverse member 14 engages the upper surface of the ejection port 26.

The body 20 has a minimum length such that when installed as described above (and as shown in FIG. 1), at least one of the spaced openings 12 is wholly exposed outside the frame 28. Accordingly, a shank 16 of a padlock 18 may then be inserted into the exposed spaced opening 12, and locked, to prevent the extraction of the safety device 10 from the channel formed by the exposed breech 26 and the magazine well 24.

Of course, with other firearms the dimensions of the body 20 and the configuration of the restricting means 14 may be different than described above in order to accomplish the functionality of the invention. Accordingly, it is to be understood that the present invention is not limited to the sole embodiment described above, but encompasses any and all embodiments within the scope of the following claims.

I claim:

1. A lockable safety device for use with a firearm, the firearm having an ejection port with a length, a width, and a depth, a magazine well with a length, a width, and a depth, a detachable magazine fitting within the magazine well, and a slide assembly having a height, said lockable safety device comprising:

an elongated body having a first end, a second end, and a length therebetween;

a width less than the length of the ejection port and the width of the magazine well;

a thickness less than the width of the ejection port and the depth of the magazine well;

a transverse member at said first end, said transverse member having a first end, a second end, a length therebetween, and a center section therebetween, said transverse member's length being greater than the width of the ejection port;

at least one opening along said elongated member's length, said opening being dimensioned and configured to receive a lock; and the distance between said transverse member and said at least one opening being greater than the sum of the slide assembly's height and the magazine well's length.

2. The lockable safety device for use with a firearm according to claim 1, wherein said transverse member is approximately centered within said elongated member's first end.

3. The lockable safety device for use with a firearm according to claim 1, wherein said transverse member is an elongated cylinder.

4. The lockable safety device for use with a firearm according to claim 1, wherein said transverse member is perpendicular to said elongated member.

5. The lockable safety device for use with a firearm according to claim 1, wherein said at least one opening is circular.

6. The lockable safety device for use with a firearm according to claim 1, wherein said at least one opening is adjacent said second end.

7. The lockable safety device for use with a firearm according to claim 1, wherein said lock device is dimensioned and configured so as to be removable from said body.

8. The lockable safety device for use with a firearm according to claim 1, wherein said lock is a padlock.

* * * * *